US009070353B2

(12) United States Patent
Gross

(10) Patent No.: US 9,070,353 B2
(45) Date of Patent: Jun. 30, 2015

(54) ADVANCED PICKUP SELECTOR SWITCH ASSEMBLY

(71) Applicant: Jeffrey Gross, Hoffman Estates, IL (US)

(72) Inventor: Jeffrey Gross, Hoffman Estates, IL (US)

( * ) Notice: Subject to any disclaimer, the term of this patent is extended or adjusted under 35 U.S.C. 154(b) by 49 days.

(21) Appl. No.: 13/965,849

(22) Filed: Aug. 13, 2013

(65) Prior Publication Data

US 2014/0041514 A1 Feb. 13, 2014

Related U.S. Application Data

(60) Provisional application No. 61/742,540, filed on Aug. 13, 2012.

(51) Int. Cl.

| | |
|---|---|
| ***G10H 3/18*** | (2006.01) |
| ***G10H 3/00*** | (2006.01) |
| ***G10H 3/14*** | (2006.01) |
| ***G10H 1/18*** | (2006.01) |

(52) U.S. Cl.

CPC ..... *G10H 3/181* (2013.01); *G10H 3/182* (2013.01); *G10H 3/186* (2013.01); *G10H 3/146* (2013.01); *G10H 3/14* (2013.01); *G10H 3/18* (2013.01)

(58) Field of Classification Search

CPC ..... G10H 3/181; G10H 3/14; G10H 3/146; G10H 3/18; G10H 3/182; G10H 3/186

USPC ..... 84/726, 313, 723, 728, 742

See application file for complete search history.

(56) References Cited

U.S. PATENT DOCUMENTS 4,127,754 A * 11/1978 Josemans et al. ..... 200/433
4,305,320 A * 12/1981 Peavey ..... 84/737
4,426,907 A * 1/1984 Scholz ..... 84/454
4,481,854 A * 11/1984 Dugas ..... 84/736
4,686,883 A * 8/1987 Piche et al. ..... 84/313
4,711,149 A * 12/1987 Starr ..... 84/742
5,136,918 A * 8/1992 Riboloff ..... 84/723
5,136,919 A * 8/1992 Wolstein ..... 84/742
5,557,058 A * 9/1996 Lace ..... 84/735
5,763,808 A * 6/1998 Thomson ..... 84/728
5,932,827 A * 8/1999 Osborne et al. ..... 84/726
6,034,316 A * 3/2000 Hoover ..... 84/738
6,121,537 A * 9/2000 Pawar et al. ..... 84/728
6,998,529 B2 * 2/2006 Wnorowski ..... 84/726
7,105,754 B2 * 9/2006 Turner ..... 200/4
7,208,673 B2 * 4/2007 Bryce ..... 84/742
7,304,232 B1 * 12/2007 Nicholes ..... 84/741
7,446,248 B2 * 11/2008 Skinn et al. ..... 84/312 R
7,754,985 B2 * 7/2010 Gordon et al. ..... 200/1 R (Continued)

*Primary Examiner* — David Warren
*Assistant Examiner* — Christina Schreiber

(57) ABSTRACT

The Advanced Pickup Switch is a lever-style switch that will allow any guitarist, with a minimal amount of technical skill, to alter the pickup wiring configuration of their electric guitar for altering the tonal choices available without the need to manually hard-wire each connection. The tonal alterations are effected via rotationally and axially displaceable multi-layer printed circuit board (PCB) discs that contain pre-determined tracings for specific pickup coil configurations. These are attached to the outboard sides of the switch with a single screw, thereby allowing for complex wiring alterations with the use of a screwdriver alone. The lateral movement of the switch and corresponding axial displacement of the PCB's allows for the expansion of the number of combinations without the use of a secondary switch. A robust two-pronged resilient detent arm cooperates with gearage for providing a switch with the tactile feedback that is familiar and comfortable to guitarists worldwide.

20 Claims, 14 Drawing Sheets

(56) References Cited

U.S. PATENT DOCUMENTS

| | | | | |
|---|---|---|---|---|
| 7,935,876 | B1 * | 5/2011 | West | 84/304 |
| 7,982,123 | B2 * | 7/2011 | Mulvany | 84/726 |
| 8,253,007 | B1 * | 8/2012 | Steinberger | 84/725 |
| 8,445,770 | B2 * | 5/2013 | Jacob | 84/742 |
| 8,492,627 | B2 * | 7/2013 | DuPra | 84/8 |
| 8,796,524 | B1 * | 8/2014 | Deck | 84/313 |
| 8,796,531 | B2 * | 8/2014 | Ambrosino | 84/723 |
| 2004/0245080 | A1 * | 12/2004 | Turner | 200/329 |
| 2005/0087063 | A1 * | 4/2005 | Bryce | 84/742 |
| 2006/0037459 | A1 * | 2/2006 | Skinn et al. | 84/312 R |
| 2011/0290099 | A1 * | 12/2011 | Franklin et al. | 84/733 |
| 2012/0103163 | A1 * | 5/2012 | DuPra | 84/9 |
| 2014/0041514 | A1 * | 2/2014 | Gross | 84/726 |

* cited by examiner

ADVANCED PICKUP SELECTOR SWITCH ASSEMBLY

PRIOR HISTORY

This patent application claims the benefit of U.S. Provisional Patent Application No. 61/742,540 filed in the United States Patent and Trademark Office on 13 Aug. 2012.

BACKGROUND OF THE INVENTION

1. Field of the Invention

The present invention generally relates to a lever type pickup switch apparatus for use with instrumentation. More particularly, the present invention relates to a pickup switching apparatus or switch assembly for electric guitars for enabling the user to alter tonal characteristics of the instrument via rotationally and axially displaceable multi-layer printed circuit board discs that contain pre-determined tracings for specific pickup coil configurations.

2. Discussion of the Prior Art

Electric guitars enable the musician to create a great variety of tones. In this regard, electric guitar musicians often prefer to selectively use: pickup(s); pickup configurations; additional electrical circuitry and types of amplification in different combinations so as to produce those tonal qualities suitable to their respectively preferred playing styles. Changing between such tonalities may be a frequent requirement and can involve multiple switch operation.

On a two pickup guitar, both 3-position lever and 3-position toggle switches are common, and provide the primary means of selection and will connect either pickup alone at its extreme index positions, or both pickups in parallel in its central index position for resultant amplification. This switch element is now a long-established feature of electric guitars.

On a three pickup guitar, a conventional five-position switch is the primary means of selection and will connect bridge pickup alone, bridge and middle pickups in parallel, middle pickup alone, middle and neck pickups in parallel, and neck pickup alone for resultant amplification in respective index positions. This switch element is now also a long-established feature of electric guitars.

Some of the more pertinent art relating to means for altering tonal characteristics of instruments and the like are briefly described hereinafter. U.S. Pat. No. 4,481,854 ('854 patent), issued to Dugas, for example, discloses a Control for Musical Instruments. The '854 patent describes a control mechanism usable in combination with an electrical stringed and fretted musical instrument which has at least two pick-ups and a bass boost filter means and a high boost filter means.

The output of the instrument is a combination of the magnitude of the pick-ups and the magnitude of the filter means. In accordance with the invention, a single joystick control varies all of these magnitudes simultaneously so as to simultaneously vary the entire combination with a single control. In accordance with a further embodiment of the invention, a second joystick control will simultaneously control volume and panning between two speakers.

U.S. Pat. No. 5,136,918 ('918 patent), issued to Riboloff, discloses a Guitar pickup switching system for selecting between and within two standard tonalities. The '918 patent describes a switching system for an electric guitar using bridge and fingerboard humbucker pickups and a single coil intermediate pickup wherein distinct groups of GIBSON tonality and FENDER tonality can be readily selected. The system uses a two-gang, five position switch for tone selection, the switch employing two, double contacting wipers; and, for mode selection either a toggle or push-pull double pole, double throw switch is utilized.

U.S. Pat. No. 7,208,673 ('673 patent), issued to Bryce, discloses a Bi-Directional Switch Apparatus with Electric Guitar Applications. The '673 patent describes a selector switch for musical instruments, such as electric guitars, having a single, manually operated toggle member adapted to perform greater functionality. A selector switch is disclosed which indexes longitudinally for the electrical connection of pickup(s) for resultant amplification but will additionally provide further associated connectivity by means of a transverse indexing motion thus availing expanded switching function from a single switch apparatus. The '673 patent describes a bi-directional switch arrangement that can provide up to ten positions for a pickup switch application in an electric guitar. The key limitation is that once the pickup coils are hard-wired to the switch, there is no means to easily change the output combinations of those pickup coils.

U.S. Pat. No. 7,754,985 ('985 patent), issued to Gordon et al., discloses an Electronic Switch Assembly with Configurable Functionality. The '985 patent describes an electrical switch assembly comprising a generally planar substrate. A functional switch and at least one identification switch are mounted to the substrate. A switch body supports a switch actuator which is movable between multiple positions. An arrangement of one or more projecting members extends from the switch body. The switch body is mounted on or to the substrate such that the switch actuator operatively engages the functional switch, and the arrangement of projecting members operatively engages at least one of the identification switches to create a unique electronic identifier for the electrical switch assembly.

The '985 patent describes an arrangement whereby the functionality of a particular switch can be configured as desired by the use of different identification switches in conjunction with a functional switch. One of the limitations of this arrangement is that only single throw or double throw switch can be used as a functional switch. Also, considerable amount of space will be required to implement such a switch arrangement. In the context of an electric guitar application, this would be considered a severe limitation since a very compact yet tactile switching is required.

U.S. Pat. No. 8,445,770 ('770 patent), issued to Jacob, discloses a Programmable Switch for Configuring Circuit Topologies. The '770 patent describes a programmable switch for configuring circuit topologies. The switch can be any type of mechanical or electronic switch. Every setting of the switch can be programmed by a user, selecting topologies such as circuit elements in series, in parallel, in phase or out of phase. In a dual switch embodiment, the first switch selects the circuit elements to be used, and the second switch configures those selected elements in a wide variety of topologies. This division in switch circuit design between element selection and then topology provides an extremely wide range of circuit topologies available, unlike prior art designs.

The primary idea in the '770 patent is that of a program bank that allows the selection and combination of various pickup elements. This invention provides a means for a very wide variety of combinations, but also introduces complexity with regards to everyday usage, especially when applied to an electric guitar. A guitarist will be required to have basic knowledge of programming and appropriate tools, software and hardware to be able to change the output configurations of this switch.

From a review of the prior art generally and the foregoing disclosures particularly, it will be seen that the prior art perceives a need for an advanced pickup selector switch assembly having rotationally and axially displaceable multi-layer printed circuit board discs that contain pre-determined tracings for specific pickup coil configurations usable in combination with a robust two-pronged detent mechanism for enhancing tactile feedback to the end user when changing switch positions. Accordingly, the present invention provides such a switch assembly, as summarized in more detail hereinafter.

SUMMARY OF THE INVENTION

The 'Advanced Pickup Switch' (APS) described in these specifications with a view toward being specifically applied on an electric guitar. The APS can be readily adapted to other applications requiring multiple switch positions with a discernible tactile feedback during position changes and an arrangement wherein a subset of switch positions can be readily re-configured as desired by the end user. Prior art reveals existence of multiple position switches for similar applications, albeit without a capability to allow re-configuration of the switch by the end user.

A switch that allows the end user to readily re-configure the behavior of a subset of the switch positions is highly desirable because of the flexibility provided by such a switch. Specifically, in relation to its application on an electric guitar, the guitarist (end user) may desire to change the tonality of the guitar by placing the various pickup coils in series, parallel, and/or out-of-phase configurations on an as-needed basis. The present invention provides that level of flexibility to the end user.

To achieve this primary objective, the pickup switch assembly according to the present invention is designed for use with an electric guitar enables a user to selectively alter pickup signal output. The pickup switch assembly according to the present invention basically comprises an arm assembly, a switch base plate, opposed terminal base plate assemblies, first and second circuit board assemblies, and a resilient Y-shaped or two-pronged detent member.

The arm assembly preferably comprises a central hub structure and an arm structure. The central hub structure preferably comprises a detent-engaging first hub half and a second hub half, which first and second hub halves are axially aligned, the detent-engaging first hub half comprises a lower hub structure, the lower hub structure comprises a series of radially extending detent teeth for engaging the two-pronged detent member. The arm structure preferably comprises an arm that extends in a direction opposite the lower hub structure.

The switch base plate preferably comprises an inverted U-shaped transverse construction, which construction comprises opposed lower wall sections and an upper wall-spanning section. The upper wall-spanning section interconnects the lower wall sections and comprises an arm-receiving or arm-letting aperture. The arm of the arm assembly extends through the arm-receiving or arm-letting aperture. The wall-spanning section interfaces or attaches to a guitar structure for mounting the switch to the guitar, and the arm enables a guitarist to manually select switch positions.

The terminal base plate assemblies each comprise a terminal base plate and a series of terminals. The terminal base plates each comprise an upper base plate attachment portion and a lower board-engagement portion. The base plate attachment portions are linear at one edge thereof and attached to the lower wall sections. The board-engagement portions are each rounded and comprise a hub-receiving aperture. The terminals are attached to the board-engagement portions and extend radially therefrom. The hub-receiving apertures receive the first and second hub halves, which hub halves are axially displaceable as received by the hub-receiving apertures.

The circuit board assemblies each preferably comprise multilayered, current-conductive circuitry, and are attached to axially opposed ends of the first and second hub halves. The Y-shaped or double-pronged detent member comprises opposed, upwardly extending detent-engaging arms and a lower base portion. The upwardly extending detent-engaging arms resiliently and simultaneously engage arc-spaced or longitudinally-spaced sets of detent teeth of the lower hub structure for selectively positioning the arm assembly in a select arm position.

The arm is longitudinally and laterally positionable via the arm-receiving aperture and the first and second hub halves are respectively rotatively and axially displaceable via said longitudinal and lateral positions. The current-conductive circuitry is selectively engageable with the terminals via select arm assembly positions for enabling signals to pass through said circuitry. The terminals are in electrical communication with a plurality of guitar-based pickups for directing signals from the guitar-based pickups through the terminals and said circuitry for further signal output.

In contrast to the '673 patent, the pickup switch assembly according to the present invention, by contrast, provides certain means to easily "hot swap" printed circuit boards that dictate the effective combinations of the pickup coils in addition to providing up to ten positions. This provides a significant advantage to a performing musician who may have a need to change the tonal characteristics of the guitar without needing extensive tools and in a time-effective manner.

In contrast to the 985 patent, the pickup switch assembly according to the present invention achieves a configurable switching arrangement in a compact space and yet provides the necessary tactile feedback during its operation. A 5-position lever switch is quite common for electric guitar applications. Switches currently available in the market have a fixed configuration which cannot be changed without complete disassembly of the switch.

The key invention in the pickup switch assembly according to the present invention is the placement of two printed circuit boards (PCBs) with pre-determined electrical traces on the outboard side of the switch. These PCBs are held in place with screws and easily replaceable without the need for a complete disassembly of the switch. One of the two PCBs will be active at a given time depending on the lateral position of the APS switch. In this way, a 10-position configurable switch arrangement is provided in approximately the same space as a 5-position non-configurable switch currently available in the market.

In contrast to the '770 patent, the key innovation in the APS design is the use of a printed circuit board (PCB) with electrical traces on multiple layers that provide a unique set of combinations. The design uses two 'hot-swappable' PCBs on the outboard sides of the switch, each held with a screw. Either of these PCBs can be replaced with another PCB that contains a different set of traces providing different combinations of the pickup elements. No knowledge of programming is required on the part of the guitarist and no special software or hardware tools are required. A guitarist can have a collection of such PCBs with pre-determined set of output configurations.

BRIEF DESCRIPTION OF THE DRAWINGS

Other features of my invention will become more evident from a consideration of the following brief descriptions of drawings.

DETAILED DESCRIPTION OF THE PREFERRED EMBODIMENT

Figure 1:
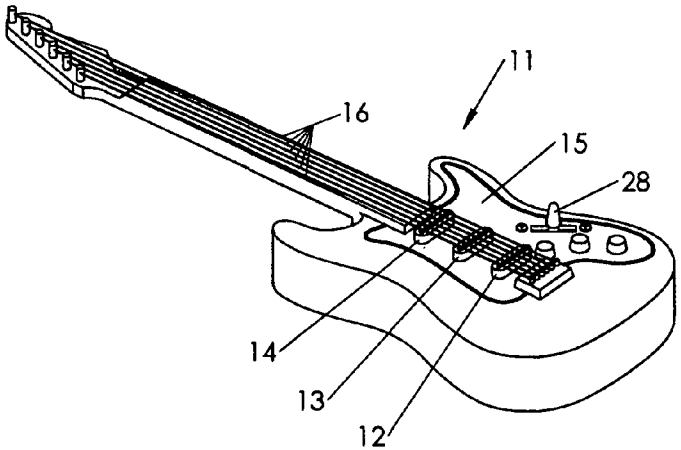
FIG. 1 is a top perspective view of an electric guitar outfitted with a pickup switch assembly according to the present invention, which guitar comprises a series of three pickup coils juxtaposed adjacent vibratory strings.
Figure 1A:
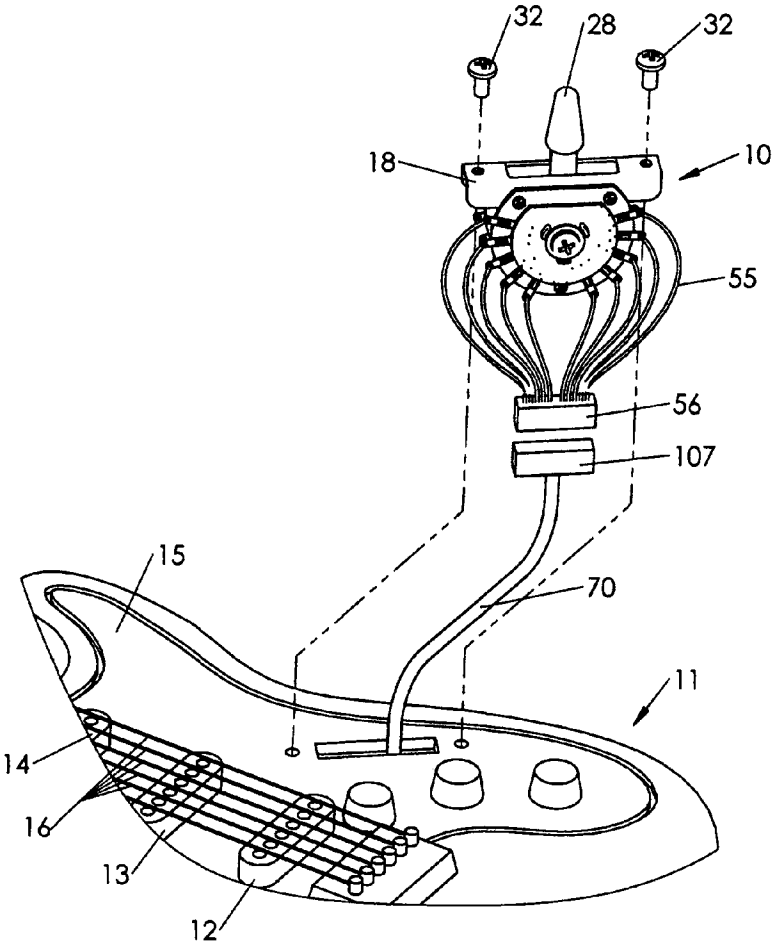
FIG. 1A is an enlarged fragmentary top perspective view of a section of the guitar and switch assembly, the switch assembly being exploded from the guitar to show structures for enabling electrical communications therebetween.
Figure 3:
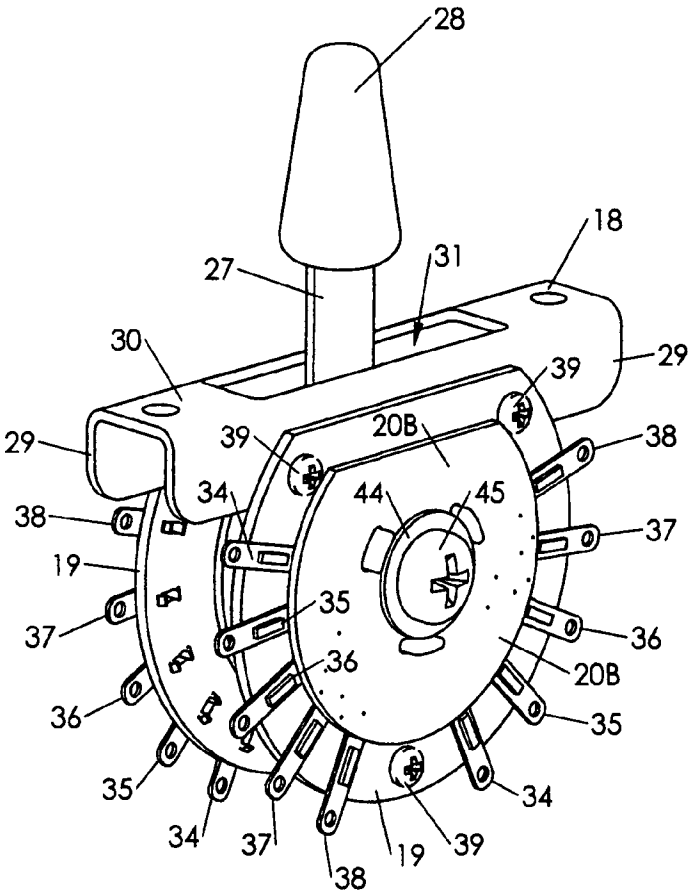
FIG. 3 is a second enlarged top perspective view of the pickup switch assembly according to the present invention.
Figure 2:
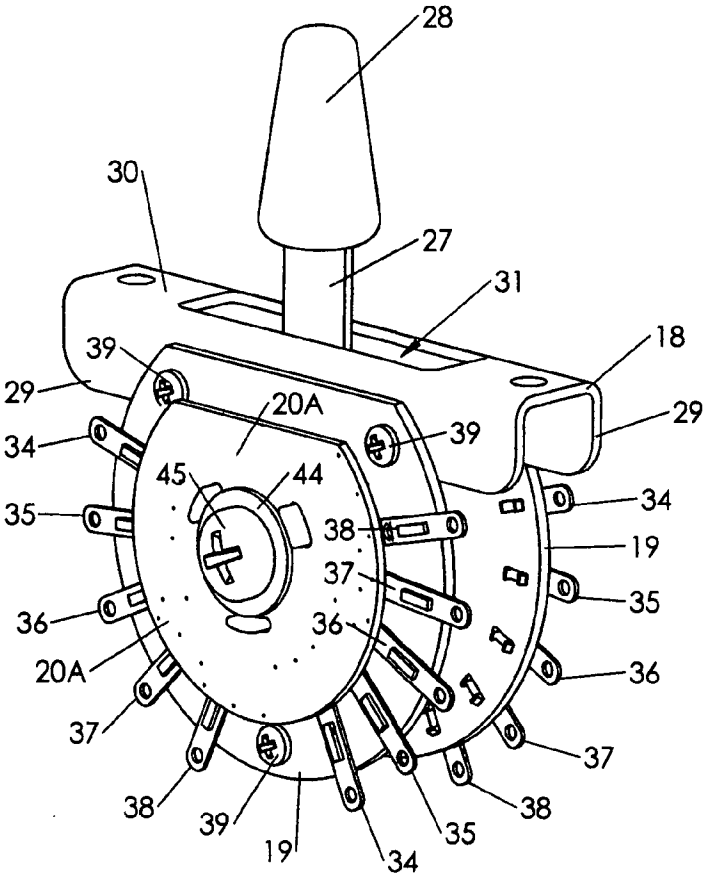
FIG. 2 is a first enlarged top perspective view of the pickup switch assembly according to the present invention.

Referring now the drawings with more specificity, the present invention essentially provides a pickup switch assembly as at 10 for enabling a musician to selectively alter tonal qualities of his or her instrument (e.g. an electric guitar 11). A pickup as at 12, 13 or 14 basically consists of a permanent magnet with a core of material such as alnico or ceramic, wrapped with a coil of several thousand turns of fine enameled copper wire.

The pickup is most often mounted on the body of the instrument, but can be attached to the bridge, neck and/or pickguard, as on many electro-acoustic archtop jazz guitars and string basses. The permanent magnet magnetizes the steel strings 16 above it and the steel strings 16 essentially become moving magnets when they vibrate thereby inducing an alternating current through the coil of wire. This signal is then carried to amplification or recording equipment via a cable. There may also be an internal preamplifier stage between the pickup and cable.

A pickup switch basically enables the end user to alter tonal qualities of the instrument because it controls which pickups or which combinations of pickups are on at any given time. The 'Advanced Pickup Switch' (APS) or switch assembly 10 according to the present invention is preferably designed for application on an electric guitar 11. The APS, however, can be readily adapted to other applications requiring multiple switch positions with a discernible tactile feedback during position changes and an arrangement wherein a subset of switch positions can be readily re-configured as desired by the end user.

As is noted hereinabove, the prior art reveals the existence of multiple position switches for similar applications, albeit without a capability to allow re-configuration of the switch by the end user. The switch assembly 10 according to the present invention allows the end user to readily re-configure the behavior of a subset of the switch positions is highly desirable because of the flexibility provided by such a switch.

Specifically, in relation to its application on an electric guitar, the guitarist (end user) may desire to change the tonality of the guitar by placing the various pickup coils in series, parallel, and/or out-of-phase configurations on an as-needed basis. The switch assembly 10 described in the following provides that level of flexibility to the end user or musician.

In an electric guitar as at 11, there are generally three pickup coils as at 12-14. Such coils may include a bridge pickup coil 12, a middle pickup coil 13, and a neck pickup coil 14 and are so named according to their location on the guitar body 15. It is noted that current pickup switches on the market generally provide 3 or 5 positions (indexed longitudinally). These provide a limited number of configurations to a guitarist.

Prior switches also describe arrangements that provide twice as many (6 or 10) positions by allowing the switch arm to be indexed laterally, in addition to the longitudinal indexing. Although an improvement on the original design, these switches still do not provide a level of flexibility desired by guitarists. Extensive and cumbersome re-wiring is involved if a subset of the switch positions needs to provide different tonalities.

The switch assembly 10 described herein not only provides 6 or 10 positions, like prior art, but more importantly provides an arrangement wherein a guitarist (end user) can easily and quickly change the tonal characteristics of the guitar. This is achieved by using an interchangeable or laterally displaceable printed circuit board (PCB) arrangement which can be interchanged or laterally displaced without needing to re-wire any of the pickup coils 12-14.

The pickup switch assembly 10 according to the present invention is designed for use with an electric guitar 11 for enabling a user to selectively alter signal output from guitar-based pickups as at 12, 13, or and/or 14. The pickup switch assembly 10 preferably comprises an arm assembly 17, a switch base plate 18, first and second terminal base plate assemblies 19, first and second printed circuit board assemblies 20A and 20B, and a resilient or spring biasable, Y-shaped detent member 21.

The arm assembly 17 preferably comprises a central hub structure 22 and an arm structure 23. The hub structure 22 is preferably transversely non-circular, the transversely non-circular hub structure 22 is received in a non-circular aperture 54 formed in the arm structure 23 of the arm assembly 17. The non-circular hub structure 22 and noncircular aperture 54 direct rotational force(s) into the hub structure 22 when re-positioning the arm 27 longitudinally.

The central hub structure 22 preferably comprises a detent-engaging first hub half 24 and a second hub half as at 25. The first and second hub halves 24 and 25 are axially aligned, and the detent-engaging first hub half 24 preferably comprises a lower hub structure or portion, which lower hub structure or portion comprising a series of radially extending detent teeth 26.

The arm structure 23 preferably comprises an arm 27, which arm 27 extends in a direction opposite the lower hub structure or detent teeth 26. The arm 27 may be preferably outfitted with a tip 28. The first and second hub halves 24 and 25 of the hub structure 22 are pin-fixed relative the arm structure via pins 53. The pins 53 essentially function to transfer force from the arm structure into the hub structure 22 for axially displacing the same when positioning the arm assembly 17 laterally.

The switch base plate 18 preferably comprises an inverted U-shaped transverse construction, which inverted U-shaped transverse construction comprises opposed lower wall sections 29 and an upper wall-spanning section 30. The upper wall-spanning section 30 interconnects the lower wall sections 29 and comprises an arm-receiving aperture as at 31. The arm 27 extends through the arm-receiving aperture 31 of the wall-spanning section 30 which wall spanning section 30 attaches to a guitar or instrument surface or body as at 15 via (pan head screw type) fasteners 32 such that the arm 27 enables a guitarist or end user to manually (i.e. with one's fingers) select switch positions.

The first and second terminal base plate assemblies 19 each preferably comprise a circular segment-shaped or D-shaped terminal base plate 33 and a series of terminals, including signal/ground terminals 34, bridge/HSS 1 terminals 35, HSS 2 terminals 36, middle terminals 37, and neck terminals 38. The D-shaped terminal base plates 33 each comprise a flattened upper base plate attachment portion and a lower board-engagement portion.

The upper base plate attachment portions are basically linear and attached to the lower wall sections 29 via pan head screw type fasteners 39. The board-engagement portions are each preferably rounded and comprise a hub-receiving aperture as at 41. The terminals 34-38 are preferably attached to the board-engagement portions via terminal rivets 40. The terminals 34-38 extend radially from the board-engagement portions of the terminal base plates 33. The hub-receiving apertures 41 receive the first and second hub halves 24 and 25. The first and second hub halves 24 and 25 are axially displaceable along axis 100 as received by the hub-receiving apertures 41.

The first and second circular segment-shaped or D-shaped circuit board assemblies 20A and 20B each comprise current-conductive circuitry or contacts as at 42. The current-conductive circuitry or contacts 42 come(s) into contact with select terminals 34-38 as selected by the end user by manually choosing from the positions shown in FIGS. 20-29. FIGS. 15-19 depict side views of the positions otherwise shown in 20-24. The circuit board assemblies 20A and 20B are each attached to the first and second hub halves 24 and 25 via wave springs 43, washers 44, and pan head screw type fasteners 45, rotating about axis 100 when the arm 27 is re-positioned longitudinally, and axially displacing along axis 100 when the arm 27 is re-positioned laterally.

Believed central to the practice of the switch assembly 10 is the resilient spring-biasable Y-shaped detent member 21 as it cooperates with the detent teeth 26 of the lower hub portion for providing a robust tactile feedback mechanism or means for the end user or musician. In this regard, the reader will note that the Y-shaped detent member 21 preferably comprises opposed, upwardly extending detent-engaging arms as at 46, and a lower base portion 47.

Each detent-engaging arm 46 preferably comprises a detent-engaging tooth or nipple 48 for engaging the arc-spaced sets of detent teeth 26 of the lower hub structure for enhancing tactile feedback from the select arm position. The detent teeth 26 of the lower hub portion comprise first and second gear halves as at 49 and 50, and a tooth-interconnecting center ridge as at 51.

The tooth-interconnecting center ridge 51 essentially functions to provide structural separation between the first and second gear halves 49 and 50, which provided structural separation further enhances tactile feedback from the switch assembly when positioning the arm assembly 17 laterally. The detent-engaging arms 46 may further preferably comprise arched sections as at 52, which arched sections 52 reduce stress and enhance the response in the detent-engaging arms 46 when positioning the arm assembly 17 laterally.

The lower base portion 47 of the Y-shaped detent member 21 is fastened to the lower board-engaging portions of the terminal base plates 33 via a standoff structure 57 as fastened to the plates 33 via pan head screw type fasteners 39. Together, the wall-spanning section 30 of the switch base plate 18 and the standoff structure 57 maintain the terminal base plates 33 in parallel relation to one another. The terminal base plates 33 thus define parallel plate structures fastened via three axes extending through the fasteners 39.

Figure 5:
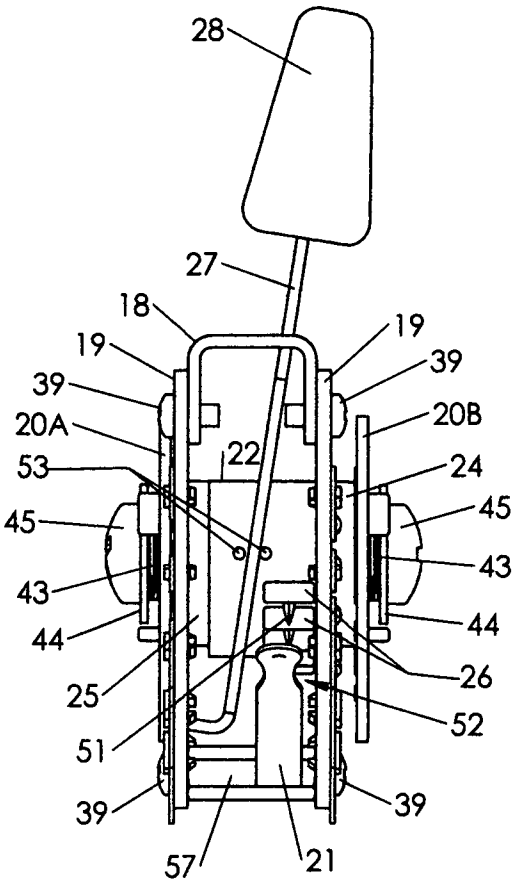
FIG. 5 is a second longitudinal or end view of the pickup switch assembly according to the present invention showing the arm assembly in a second lateral indexing position with the arm of the arm assembly being in an oblique orientation.
Figure 4:
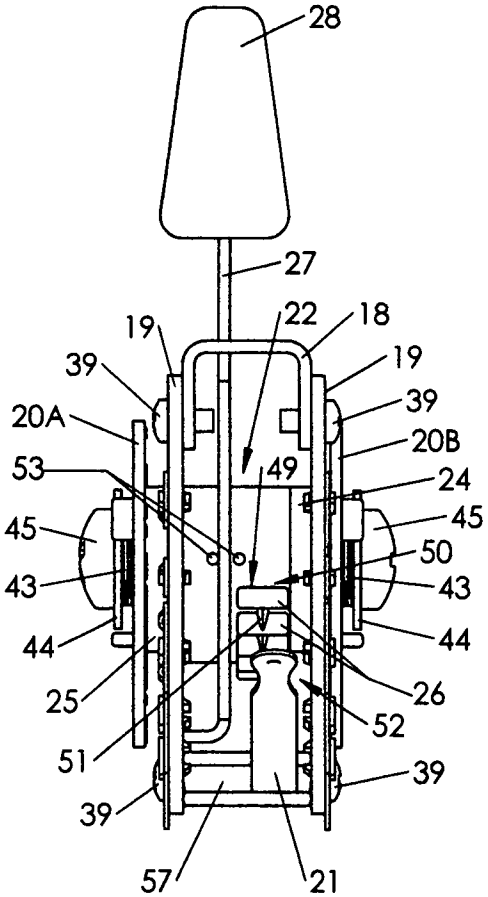
FIG. 4 is a first longitudinal or end view of the pickup switch assembly according to the present invention showing the arm assembly in a first lateral indexing position with the arm of the arm assembly being in a vertical orientation.
Figure 6A:
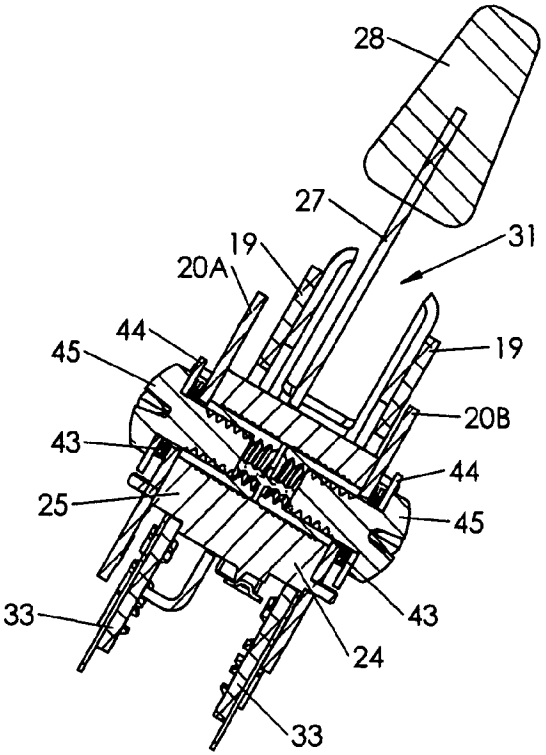
FIG. 6A is an enlarged sectional view of the pickup switch assembly as sectioned from FIG. 6.
Figure 6:
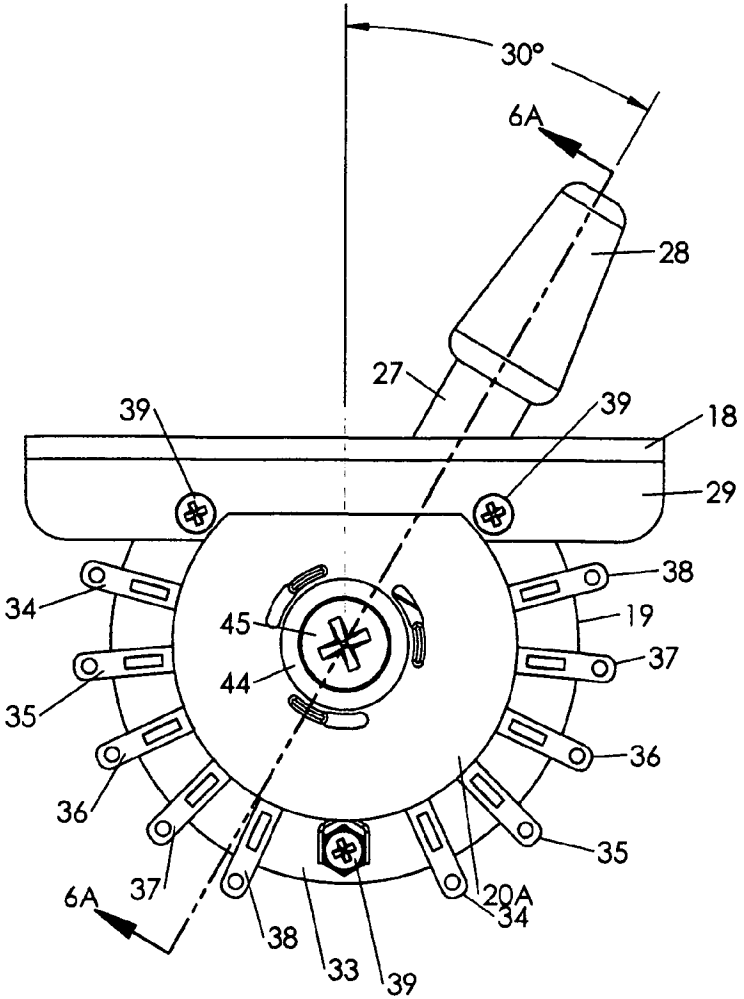
FIG. 6 is an enlarged side or lateral elevational view of the pickup switch assembly according to the present invention showing the arm assembly in a first extreme longitudinal position with the arm in the first lateral indexing position.
Figure 7A:
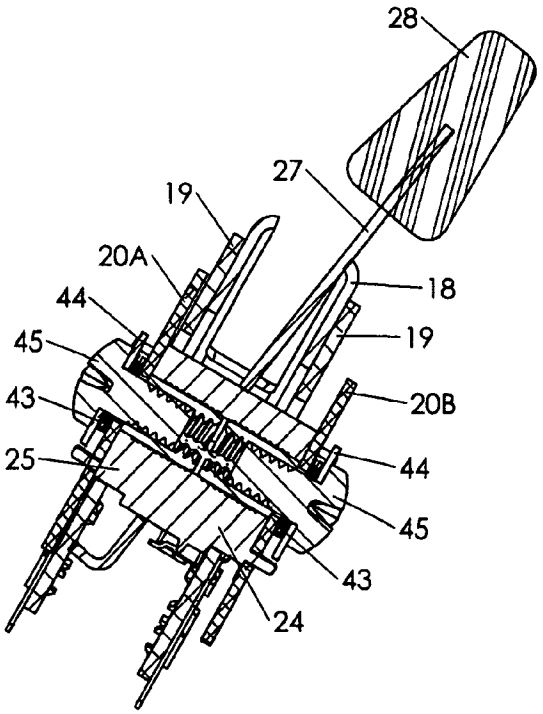
FIG. 7A is an enlarged sectional view of the pickup switch assembly as sectioned from FIG. 7.
Figure 7:
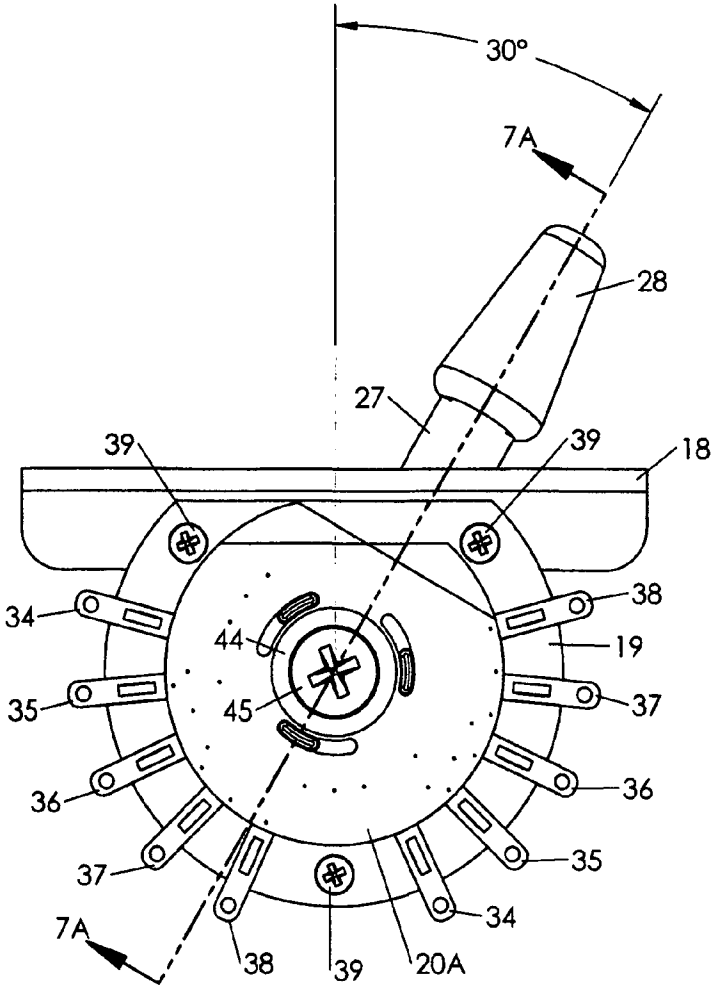
FIG. 7 is an enlarged side or lateral elevational view of the pickup switch assembly according to the present invention showing the arm assembly in a first extreme longitudinal position with the arm in the second lateral indexing position.
Figure 8:
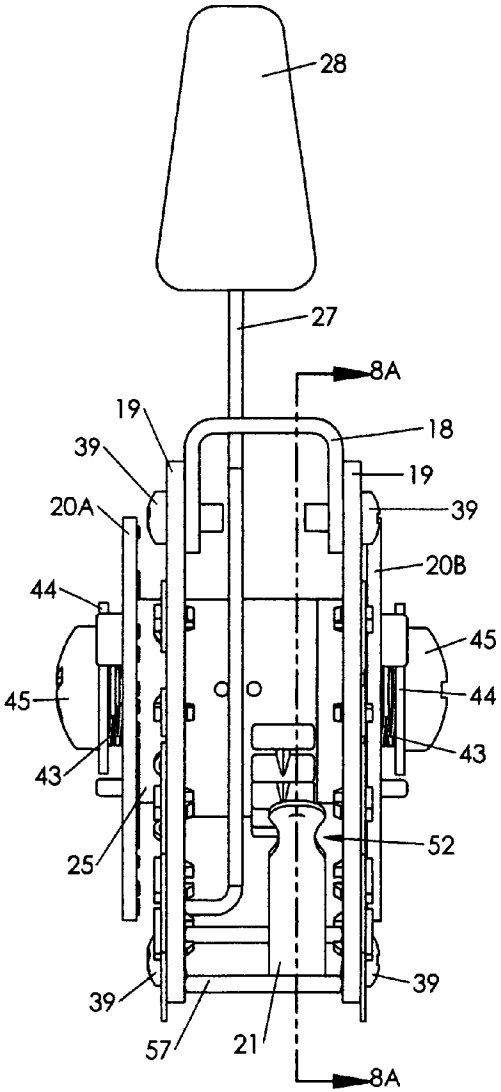
FIG. 8 is a third longitudinal or end view of the pickup switch assembly according to the present invention showing the arm assembly in a first lateral indexing position with the arm of the arm assembly being in a vertical orientation.
Figure 8A:
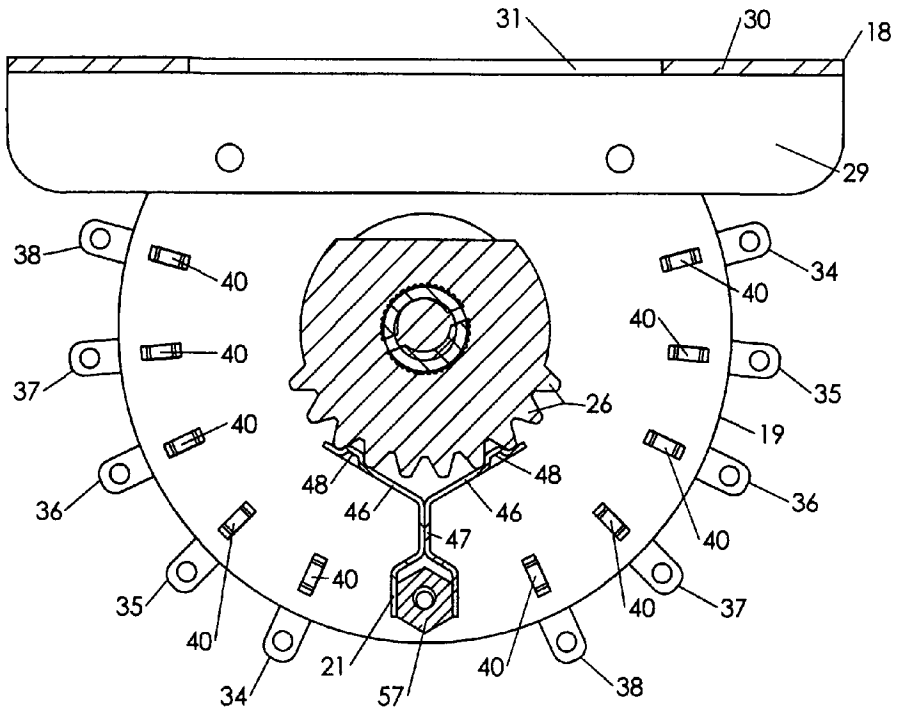
FIG. 8A is an enlarged sectional view of the pickup switch assembly as sectioned from FIG. 8.
Figure 9:
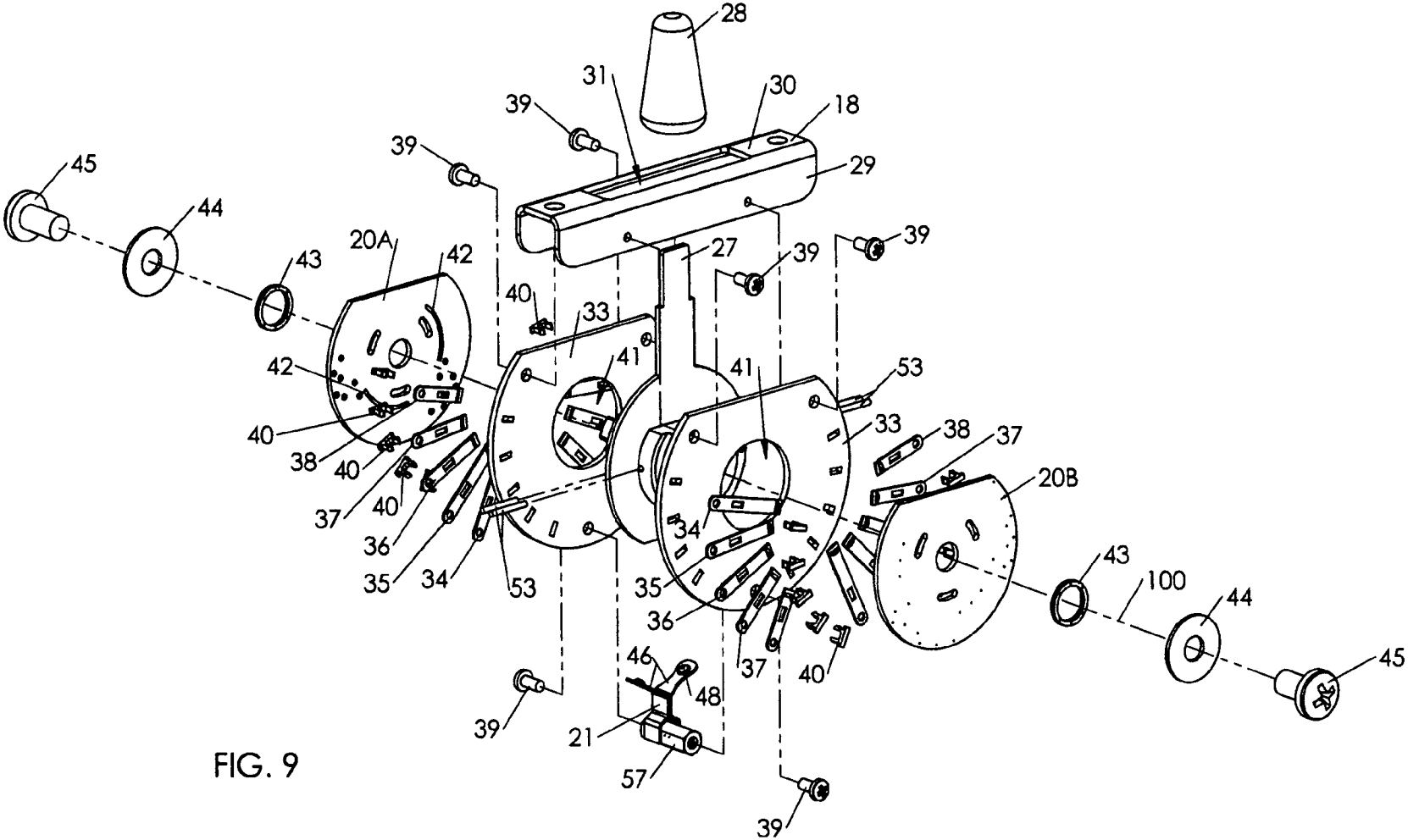
FIG. 9 is a first top exploded perspective view of the pickup switch assembly according to the present invention.
Figure 10:
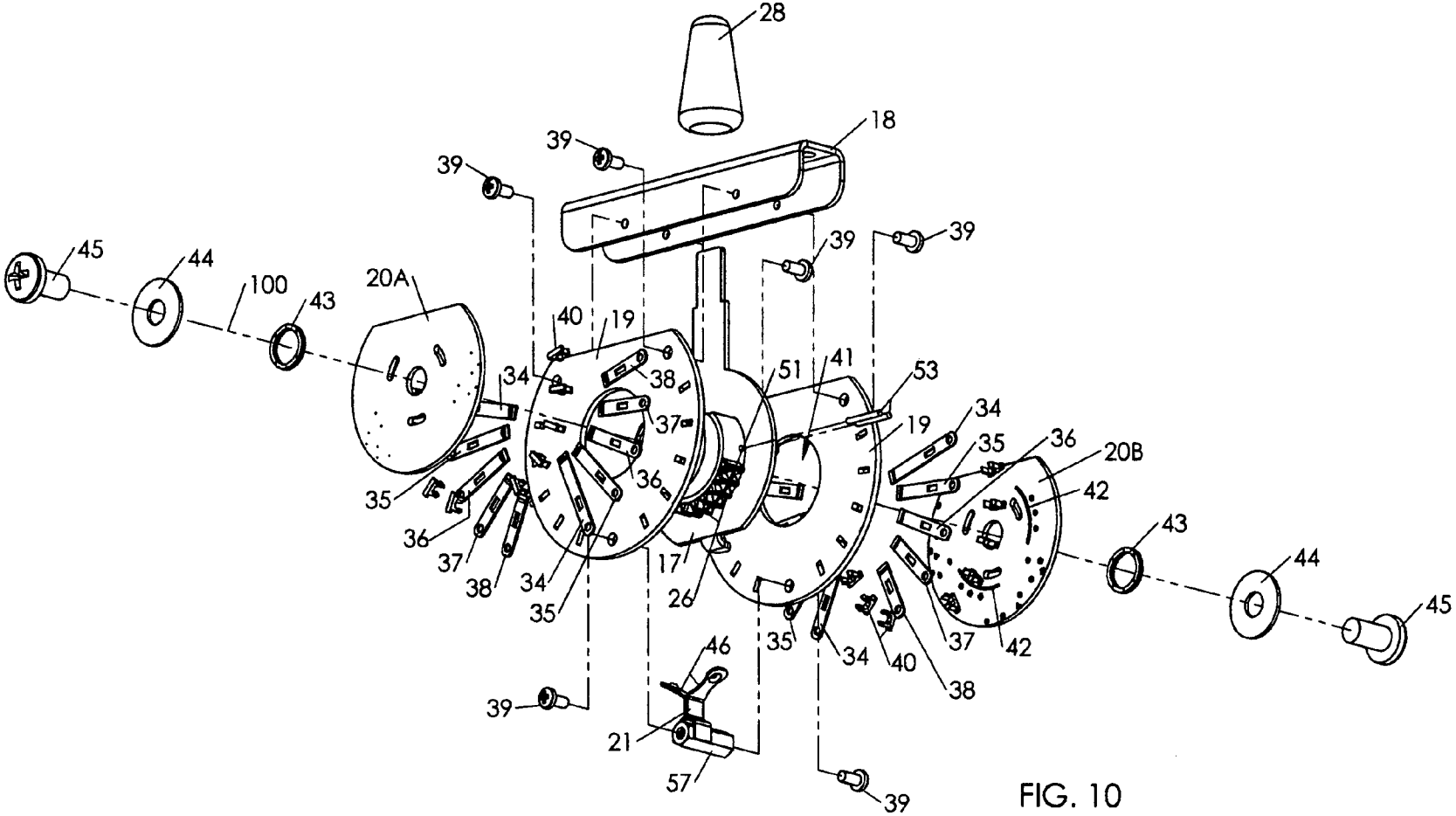
FIG. 10 is a second top exploded perspective view of the pickup switch assembly according to the present invention.
Figure 11:
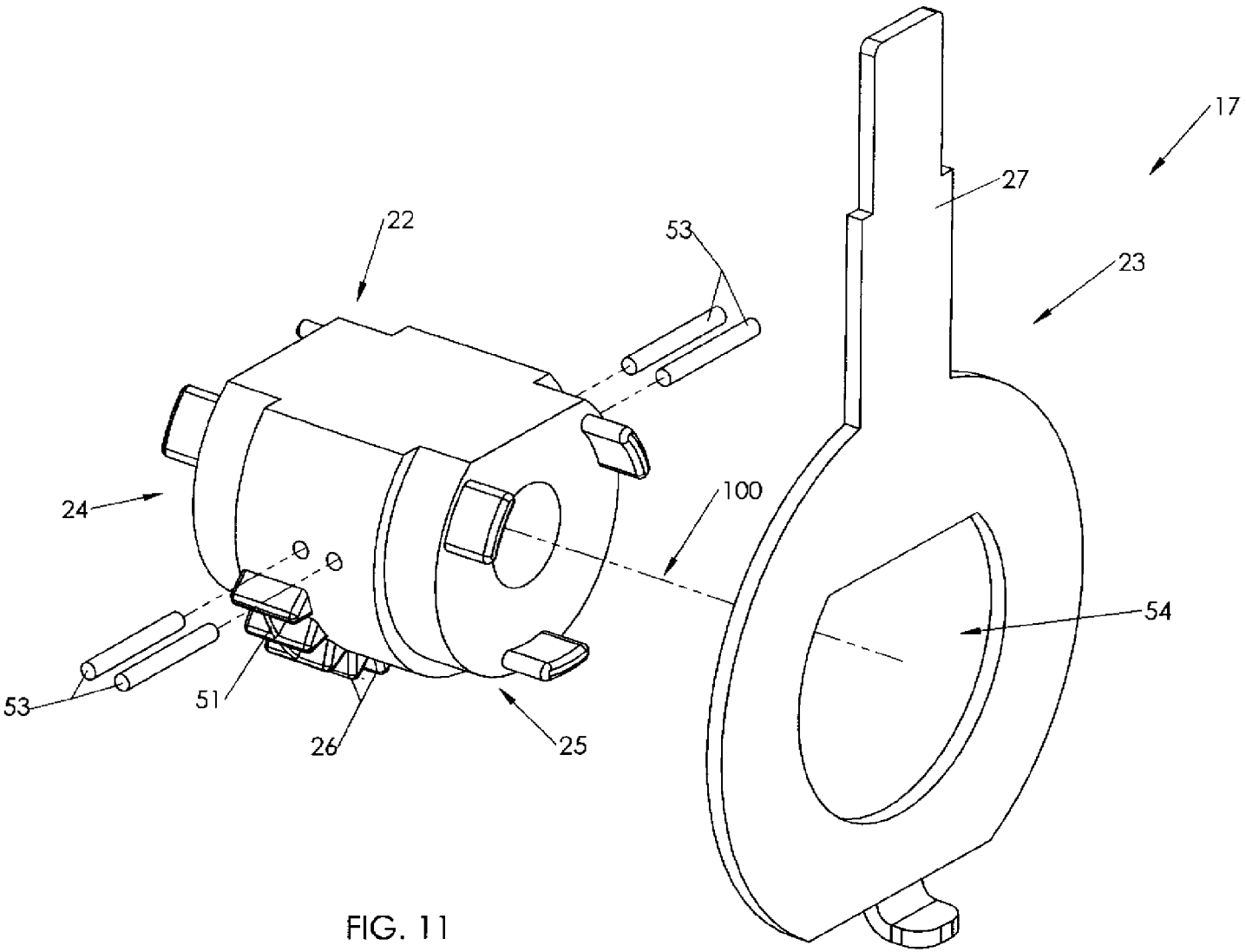
FIG. 11 is an enlarged top exploded perspective view of an arm assembly of the pickup switch assembly according to the present invention.
Figure 14:
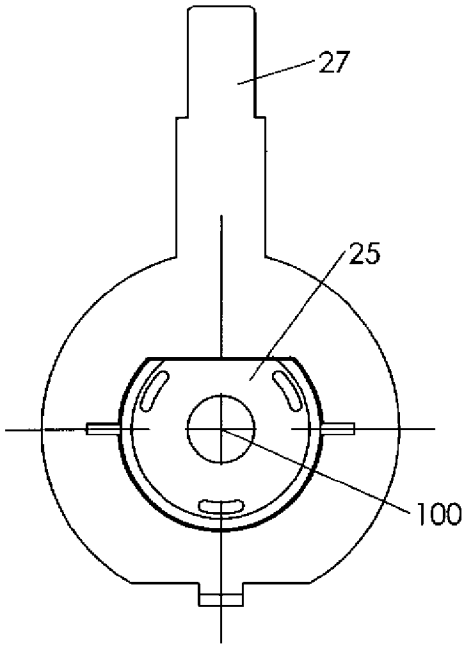
FIG. 14 is a second side or lateral view of the arm assembly of the pickup switch assembly according to the present invention.
Figure 13:
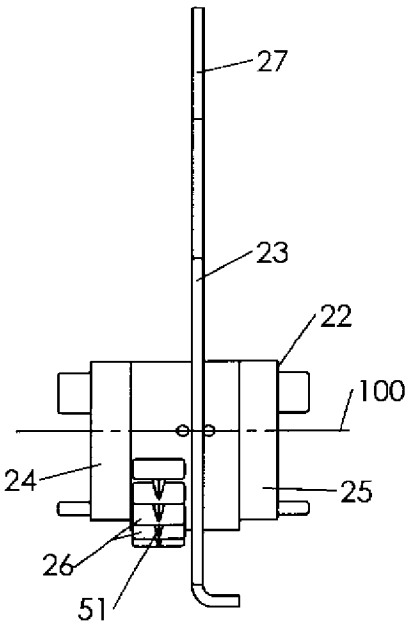
FIG. 13 is a longitudinal view of the arm assembly of the pickup switch assembly according to the present invention.
Figure 12:
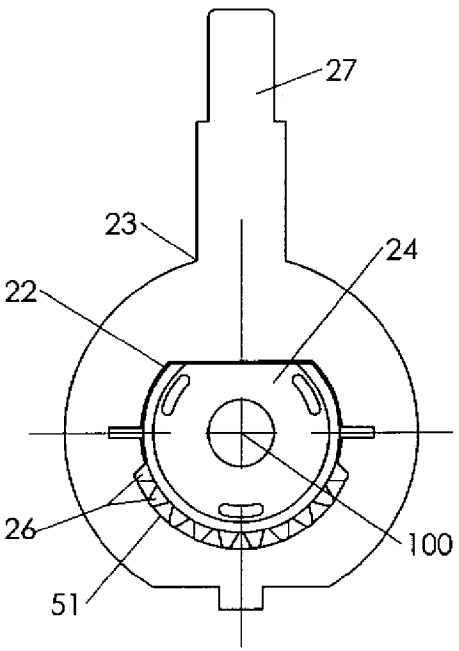
FIG. 12 is a first side or lateral view of the arm assembly of the pickup switch assembly according to the present invention.
Figure 17:
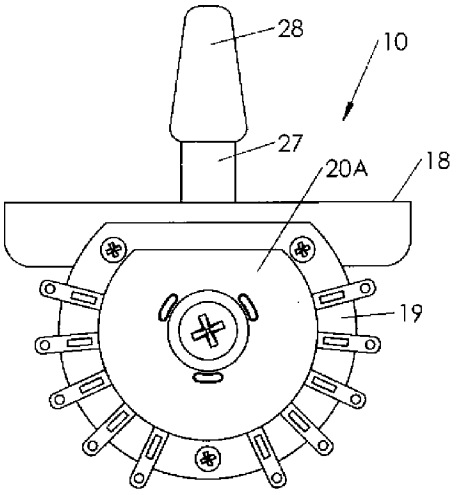
FIG. 17 is a third sequential side or lateral view of the pickup switch assembly according to the present invention showing the arm assembly in a third longitudinal position next in sequence to the second longitudinal position with the arm in the first lateral indexing position.
Figure 16:
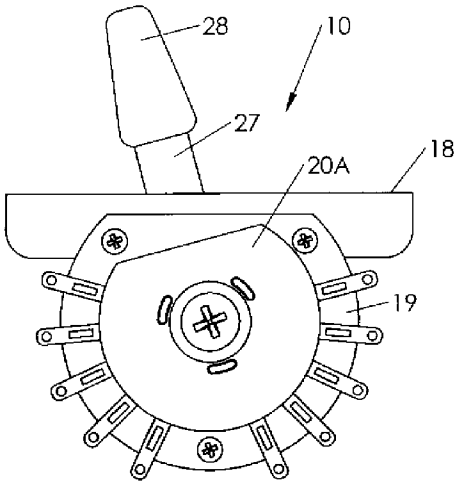
FIG. 16 is a second sequential side or lateral view of the pickup switch assembly according to the present invention showing the arm assembly in a second longitudinal position next in sequence to the second extreme longitudinal position with the arm in the first lateral indexing position.
Figure 15:
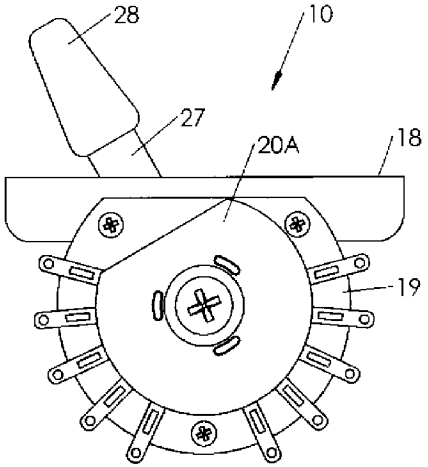
FIG. 15 is a first sequential side or lateral view of the pickup switch assembly according to the present invention showing the arm assembly in a second extreme longitudinal position with the arm in the first lateral indexing position.
Figure 19:
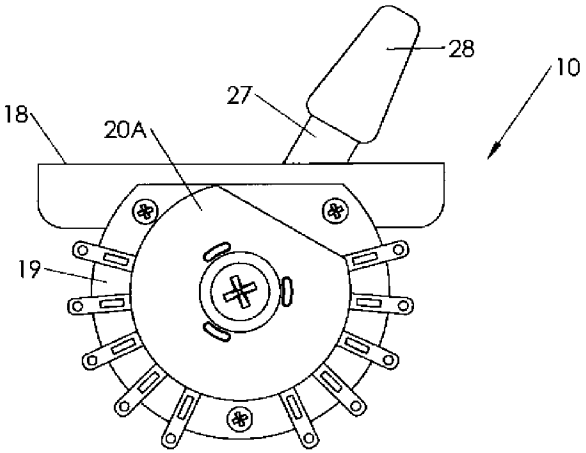
FIG. 19 is a fifth sequential side or lateral view of the pickup switch assembly according to the present invention showing the arm assembly in a fifth longitudinal position (i.e. the first extreme longitudinal position) next in sequence to the fourth longitudinal position with the arm in the first lateral indexing position.
Figure 18:
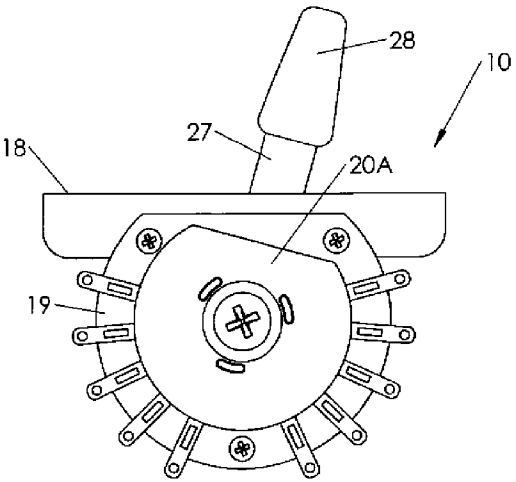
FIG. 18 is a fourth sequential side or lateral view of the pickup switch assembly according to the present invention showing the arm assembly in a fourth longitudinal position next in sequence to the third longitudinal position with the arm in the first lateral indexing position.
Figure 20:
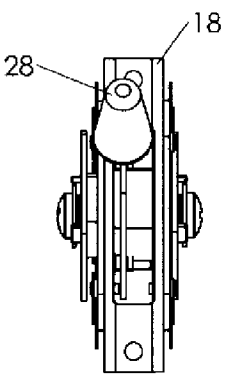
FIG. 20 is a first sequential top plan view of the pickup switch assembly according to the present invention showing the arm assembly in the second extreme longitudinal position with the arm in the first lateral indexing position.
Figure 21:
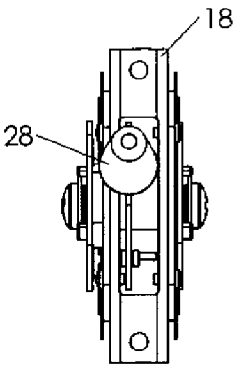
FIG. 21 is a second sequential top plan view of the pickup switch assembly according to the present invention showing the arm assembly in the second longitudinal position next in sequence to the second extreme longitudinal position with the arm in the first lateral indexing position.
Figure 22:
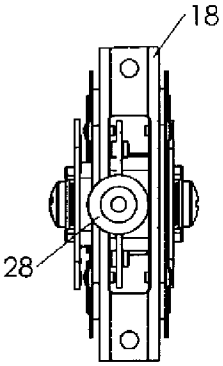
FIG. 22 is a third sequential top plan view of the pickup switch assembly according to the present invention showing the arm assembly in the third longitudinal position next in sequence to the second longitudinal position with the arm in the first lateral indexing position.
Figure 23:
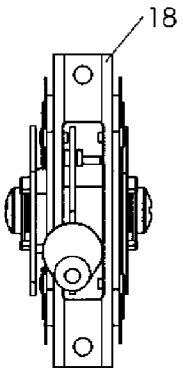
FIG. 23 is a fourth sequential top plan view of the pickup switch assembly according to the present invention showing the arm assembly in the fourth longitudinal position next in sequence to the third longitudinal position with the arm in the first lateral indexing position.
Figure 24:
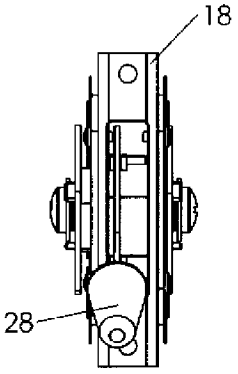
FIG. 24 is a fifth sequential top plan view of the pickup switch assembly according to the present invention showing the arm assembly in the fifth longitudinal position next in sequence to the fourth longitudinal position (i.e. the first extreme longitudinal position) with the arm in the first lateral indexing position.
Figure 25:
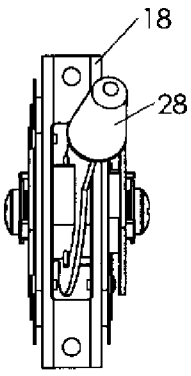
FIG. 25 is a sixth sequential top plan view of the pickup switch assembly according to the present invention showing the arm assembly in the second extreme longitudinal position with the arm in the second lateral indexing position.
Figure 26:
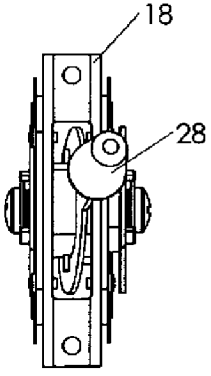
FIG. 26 is a seventh sequential top plan view of the pickup switch assembly according to the present invention showing the arm assembly in the second longitudinal position next in sequence to the second extreme longitudinal position with the arm in the second lateral indexing position.
Figure 27:
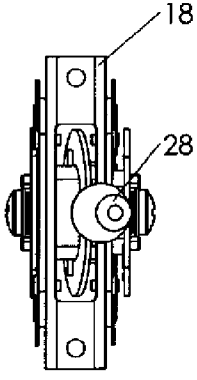
FIG. 27 is an eighth sequential top plan view of the pickup switch assembly according to the present invention showing the arm assembly in the third longitudinal position next in sequence to the second longitudinal position with the arm in the second lateral indexing position.
Figure 28:
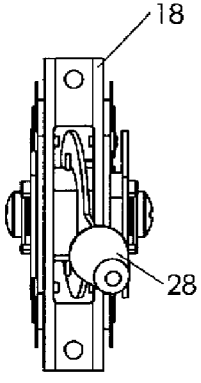
FIG. 28 is a ninth sequential top plan view of the pickup switch assembly according to the present invention showing the arm assembly in the fourth longitudinal position next in sequence to the third longitudinal position with the arm in the second lateral indexing position.
Figure 29:
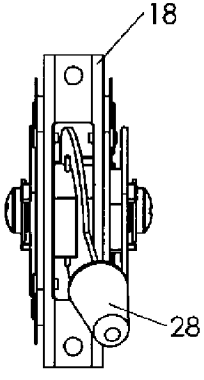
FIG. 29 is a tenth sequential top plan view of the pickup switch assembly according to the present invention showing the arm assembly in the fifth longitudinal position next in sequence to the fourth longitudinal position (i.e. the first extreme longitudinal position) with the arm in the second lateral indexing position.

The upwardly extending detent-engaging arms 46 resiliently and simultaneously engage arc-spaced or longitudinally-spaced sets of detent teeth 26 of the lower hub structure for selectively positioning the arm assembly 17 in a select arm position as comparatively depicted in FIGS. 15-29. FIGS. 15-24 depict the various longitudinal positions of a first indexing position with vertical arm; and FIGS. 25-29 depict the various longitudinal positions of a second indexing position laterally offset from the first indexing position with oblique arm. The vertical arm position is further depicted in FIGS. 4, 6A, and 8, and the oblique arm position is further depicted in FIGS. 5 and 7A for comparison purposes.

The arm 27 outfitted with the tip 28 is longitudinally re-positionable as generally depicted in FIGS. 15-19 (showing five successive longitudinal positions) versus FIGS. 20-24 (showing the same five successive longitudinal positions) versus FIGS. 25-29 (showing five successive longitudinal positions laterally offset from the those shown in FIGS. 20-24). The arm 27 is laterally re-positionable as generally and comparatively depicted in FIGS. 20-24 (showing a first lateral position wherein the arm 27 is oriented vertically) versus FIGS. 25-29 (showing a second lateral position wherein the arm 27 is oriented obliquely).

The arm-receiving aperture 31 provides an upper boundary defining the extent and longitudinal and lateral movements or displacements of the arm 27, which boundary restrictions cooperate with (1) the spacing of the detent teeth 26 longitudinally, and (2) the displacement extents of the hub structure 22 relative to the hub-receiving apertures 41 and contacts between the printed circuit board assemblies 20A and 20B and the terminals 34-38 laterally.

The first and second hub halves 24 and 25 are respectively rotatively and axially displaceable via said longitudinal and lateral positions as selected by the end user or musician. The current-conductive circuitry 42 is selectively engageable with the terminals 34-38 via the selected arm assembly positions for enabling signals to pass through select circuitry chosen by the end user. The terminals 34-38 are preferably in electrical communication with a plurality of guitar-based pickups as at 12-14 for directing signals from the guitar-based pickups 12-14 through the terminals 34-38 and circuitry of the printed circuit board assemblies 20A and 20B for further signal output (e.g. via amplification means 60).

The switch assembly 10 according to the present invention thus enables a user to selectively alter signal outputs from guitar-based pickups as at 12-14 by enabling the user to select the pickup arrangement (as selected from the group consisting of those positions set forth in Tables 1 and 2 below) he or she prefers with a robust tactile feedback mechanism provided by the longitudinally opposed detent-engaging arms 46 in gear communication with the detent teeth 26.

TABLE 1

First Lateral Indexing Position (vertical arm position)

| Switch Position | Combination |
|---|---|
| 1 (FIG. 20) | Bridge only |
| 2 (FIG. 21) | Bridge & Middle in parallel |
| 3 (FIG. 22) | Middle only |
| 4 (FIG. 23) | Middle & Neck in parallel |
| 5 (FIG. 24) | Neck only |

TABLE 2

Second Lateral Indexing Position (oblique arm position)

| Switch Position | Combination |
|---|---|
| 6 (FIG. 25) | Bridge & Neck in series |
| 7 (FIG. 26) | Bridge & Middle in series |
| 8 (FIG. 27) | Bridge, Middle & Neck in series |
| 9 (FIG. 28) | Middle & Neck in series |
| 10 (FIG. 29) | Bridge & Neck in parallel |

Figure 31:
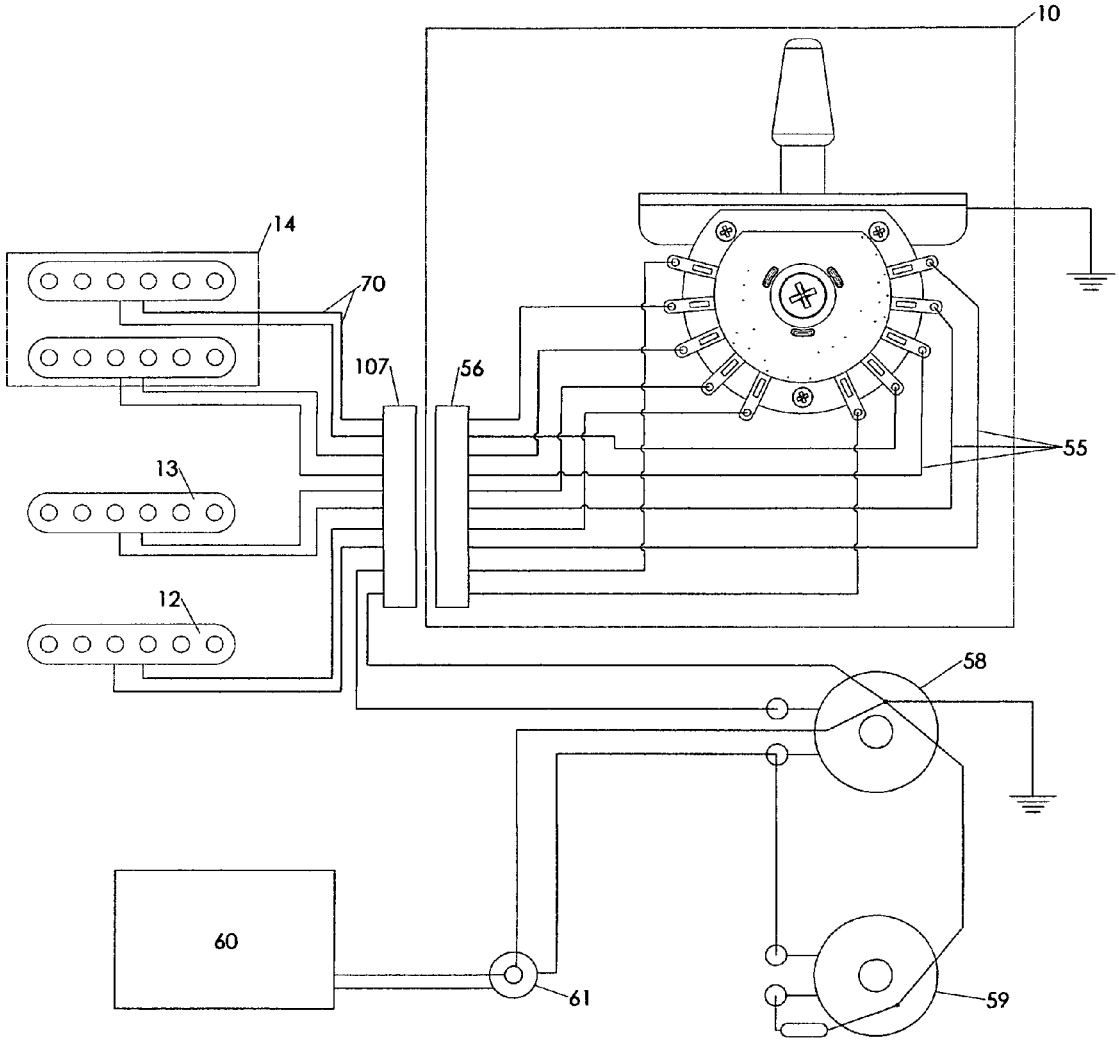
FIG. 31 is a circuit diagram diagrammatically showing the pickup switch assembly in electrical communication with a series of pickup coils, volume and toner controls, and amplification means.

Current-conductive leads 55 from the terminals 34-38 may be preferably directed through a first matable wiring harness as at 56, which wiring harness 56 may be quickly and easily placed into electrical communication with a second matable wiring harness as at 107, which second matable wiring harness 107 is in electrical communication (as at current-conductive means 70) with the pickup coils as at 12-14. The basic circuit diagram is presented in FIG. 31 for the reader's further consideration. The pickup signal output may be directed through volume and toner controls as at 58 and 59 to certain amplification means 60 via an output jack 61.

The illustrated pickup coil and wiring configurations provided in these specifications are exemplary. In other words, the provided descriptions and views are essentially examples of how the switch assembly 10 can perform. It is contemplated that the switch assembly 10 can work with a variety of coil configurations by simply modifying the design (adding contact points) to accommodate the additional leads from each additional coil.

Figure 30:
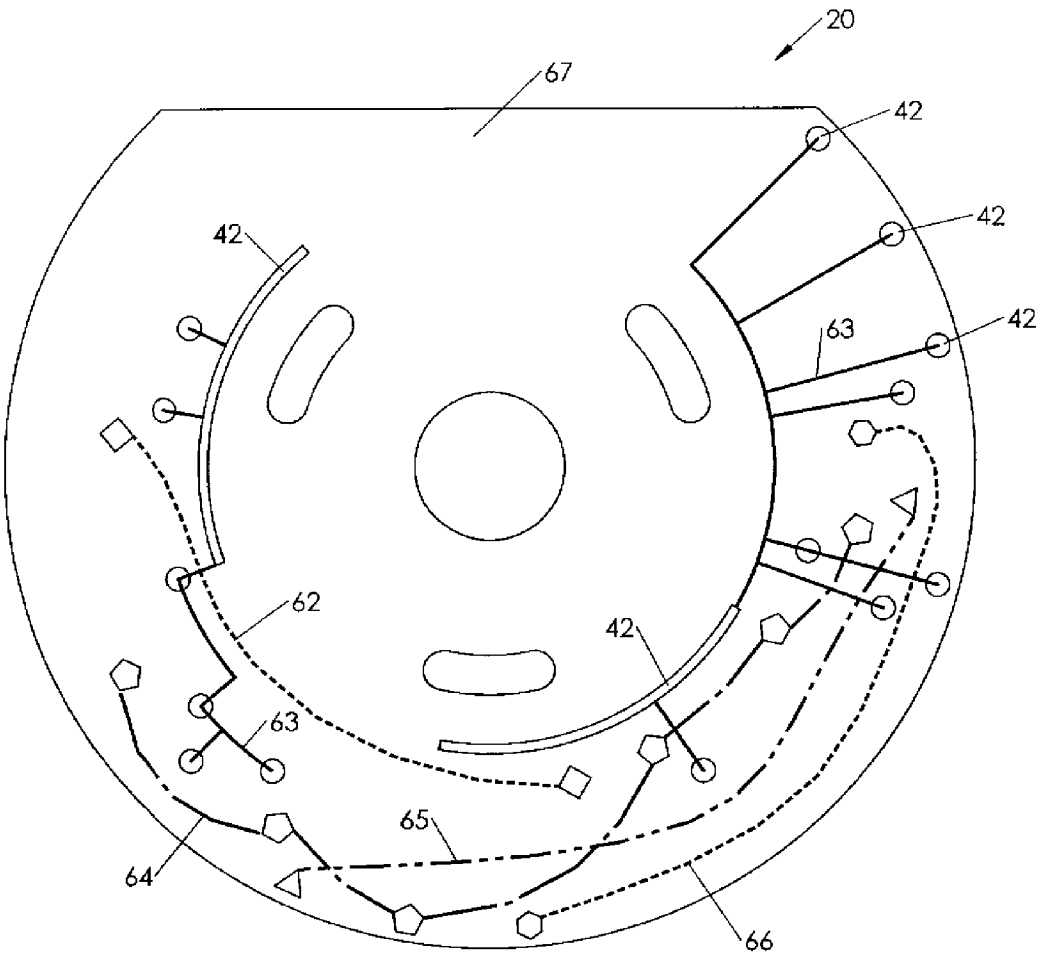
FIG. 30 is an enlarged elevational view of a printed circuit board assembly of the pickup switch assembly according to the present invention.

The actual wiring configurations themselves are not a center piece of the invention as much as the use of a multi-layer printed circuit boards 20A and 20B used to attain the wiring configurations. Naturally, the printed circuit boards 20A and 20B are not identical to allow for the pickup coil combinations set forth in Table No. 1 versus Table No. 2 above. Referencing FIG. 30, the reader will note that each line style 62-66 represents a separate electrical trace. Each trace is on a separate layer of the printed circuit board 20. Only the connecting pads or current conductive circuitry 42 are on the surface 67 contacting the terminals 34-38.

While the foregoing specifications set forth much specificity, the same should not be construed as setting forth limits to the invention but rather as setting forth certain preferred embodiments and features. For example, it is contemplated that the foregoing specifications essentially support a pickup switch assembly for use with an instrument such as an electric guitar for enabling a user to selectively alter pickup signal output.

The pickup switch assembly according to the present invention is believed to essentially comprise an arm assembly, a switch base plate or instrument-interfacing plate or instrument-interfacing means, laterally opposed terminal base plate assemblies, laterally opposed printed circuit board assemblies, and a resilient detent member.

The arm assembly preferably comprises a central hub structure and an arm structure. The central hub structure comprises a first hub half and a second hub half. The first hub half comprises a lower hub structure, which lower hub structure comprises a series of radially extending detent teeth. The arm structure comprises an arm, which arm extends in a direction opposite the lower hub structure.

The switch base plate or instrument interfacing means comprising opposed lower wall sections and an upper wall-spanning section. The upper wall-spanning section interconnects the lower wall sections and comprises an arm-receiving aperture. The arm of the arm structure extends through the arm-receiving aperture for enabling a musician or guitarist to manually select switch positions.

The terminal base plate assemblies each comprise a terminal base plate and a series of terminals. The terminal base plates are each attached to the lower wall sections and comprise a hub-receiving aperture. The terminals extend radially from the terminal base plates. The hub-receiving apertures receive the first and second hub halves, which first and second hub halves are axially displaceable as received by the hub-receiving apertures.

Each circuit board assembly comprises select electrical tracings or current-conductive circuitry for enabling the user to select pickup signal combinations. The circuit board assemblies are attached to opposed ends of the first and second hub halves. The detent member resiliently engages the detent teeth of the lower hub structure for selectively positioning the arm assembly in a select arm position. The arm is longitudinally and laterally positionable via the arm-receiving aperture and the first and second hub halves being rotatively and axially displaceable via longitudinal and lateral positions.

The current-conductive circuitry of the PCB's are selectively engageable with the terminals via select arm assembly positions for enabling signals to pass through said circuitry. The terminals are in electrical communication with a plurality of guitar-based pickups for directing signals from the guitar-based pickups through the terminals and select circuitry for further signal output, the switch assembly thus for enabling a user to selectively alter pickup signal output.

The detent member is preferably Y-shaped. The Y-shaped detent member preferably constructed from resilient spring materials comprises opposed, upwardly extending detent-engaging arms and a lower base portion. The upwardly extending detent-engaging arms simultaneously engage arc-spaced sets of detent teeth from longitudinally opposed directions for directing force into the gears from opposite directions for enhancing tactile feedback from the select arm position.

Each detent-engaging arm preferably comprises a detent-engaging tooth, which detent-engaging teeth gear-engage the arc-spaced sets of detent teeth (i.e. the teeth mesh for resisting gear movement) of the lower hub structure for enhancing tactile feedback from the select arm position.

The detent teeth may preferably further comprise first and second gear halves and a tooth-interconnecting center ridge. The tooth-interconnecting center ridge provides structural separation between the first and second gear halves for further enhancing tactile feedback from the switch assembly when positioning the arm assembly laterally.

The first and second hub halves of the hub structure are pin-fixed relative the arm structure via pins. The pins effectively function to transfer force from the arm structure into the hub structure for axially displacing the same when positioning the arm assembly laterally. The hub structure is transversely non-circular. The transversely non-circular hub structure is received in a non-circular aperture formed in the arm structure. The non-circular hub structure and noncircular aperture cooperably direct rotational force into the hub structure when positioning the arm longitudinally.

While the preferred embodiment in these specifications has been shown and/or illustrated and providing 10 overall switch positions (5 longitudinal positions×2 lateral positions), it is contemplated that the switch may also be configured to provide 6 overall switch positions (3 longitudinal positions×2 lateral positions). The central features of the present invention are believed to be the axially displaceable printed circuit boards for enabling the user to easily select pickup coil combinations, and the detent means for enabling a robust tactile feedback mechanism when moving between select switch positions.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A pickup switch assembly for use with an electric guitar configured to enable a user to selectively alter pickup signal output, the pickup switch assembly comprising:

an arm assembly, the arm assembly comprising a central hub structure and an arm structure, the central hub structure comprising a first hub half and a second hub half, the first hub half comprising a lower hub structure, the lower hub structure comprising a series of radially extending detent teeth, the arm structure comprising an arm, the arm extending in a direction opposite the lower hub structure;

a switch base plate, the switch base plate comprising opposed lower wall sections and an upper wall-spanning section, the upper wall-spanning section interconnecting the lower wall sections and comprising an arm-receiving aperture, the arm extending through the arm-receiving aperture, the arm configured to enable a guitarist to manually select switch positions;

first and second terminal base plate assemblies, said terminal base plate assemblies each comprising a terminal base plate and a series of terminals, the terminal base plates each being attached to the lower wall sections and comprising a hub-receiving aperture, the terminals extending radially from the terminal base plates, the hub-receiving apertures receiving the first and second hub halves, the first and second hub halves being axially displaceable as received by the hub-receiving apertures;

first and second circuit board assemblies, each circuit board assembly comprising current-conductive circuitry, the circuit board assemblies being attached to opposed ends of the first and second hub halves; and a resilient detent member, the detent member resiliently engaging the detent teeth of the lower hub structure configured to position the arm assembly in a select arm position, the arm being longitudinally and laterally positionable via the arm-receiving aperture and the first and second hub halves being rotatively and axially displaceable via longitudinal and lateral positions, the current-conductive circuitry being selectively engageable with the terminals via select arm assembly positions configured to enable signals to pass through said circuitry, said terminals being in electrical communication with a plurality of guitar-based pickups configured to direct signals from the guitar-based pickups through the terminals and select circuitry for further signal output, the switch assembly thus configured to enable a user to selectively alter pickup signal output.

2. The pickup switch assembly of claim 1 wherein the detent member is Y-shaped, the Y-shaped detent member comprising opposed, upwardly extending detent-engaging arms and a lower base portion, the upwardly extending detent-engaging arms simultaneously engaging arc-spaced sets of detent teeth configured to enhance tactile feedback from the select arm position.

3. The pickup switch assembly of claim 2 wherein each detent-engaging arm comprises a detent-engaging tooth, the detent-engaging teeth configured to engage the arc-spaced sets of detent teeth of the lower hub structure configured to enhance tactile feedback from the select arm position.

4. The pickup switch assembly of claim 3 wherein the arc-spaced sets of detent teeth comprise first and second gear halves and a tooth-interconnecting center ridge, the tooth-interconnecting center ridge configured to provide structural separation between the first and second gear halves, said structural separation configured to further enhance tactile feedback from the switch assembly when positioning the arm assembly laterally.

5. The pickup switch assembly of claim 2 wherein the first and second hub halves of the hub structure are pin-fixed relative the arm structure via pins, the pins configured to transfer force from the arm structure into the hub structure for axially displacing the same when positioning the arm assembly laterally.

6. The pickup switch assembly of claim 5 wherein the hub structure is transversely non-circular, the transversely non-circular hub structure being received in a non-circular aperture formed in the arm structure, the non-circular hub structure and noncircular aperture configured to direct rotational force into the hub structure when positioning the arm longitudinally.

7. The pickup switch assembly of claim 2 wherein the lower base portion of the Y-shaped detent member is fastened to a lower board-engaging portions of the terminal base plates via a standoff structure, the wall-spanning section of the switch base plate and the standoff structure for maintaining the terminal base plates in parallel relation to one another.

8. A pickup switch assembly for enabling a user to selectively alter pickup signal output, the pickup switch assembly comprising:

an arm assembly, the arm assembly comprising a central hub structure and an arm structure, the central hub structure comprising a lower hub structure, the lower hub structure comprising detent teeth, the arm structure comprising an arm, the arm extending in a direction opposite the lower hub structure;

a switch base plate, the switch base plate comprising an arm-receiving aperture, the arm extending through the arm-receiving aperture configured to enable the user to manually select switch positions;

opposed terminal base plate assemblies, comprising first and second terminal base plate assemblies, wherein each first and second terminal base plate assembly comprises a terminal base plate and a series of terminals, the terminal base plates each being attached to the switch plate and comprising a hub-receiving aperture, the terminals being attached to the terminal base plates, the hub-receiving apertures receiving the hub structure, the hub structure being axially displaceable as received by the hub-receiving apertures;

first and second circuit board assemblies, each circuit board assembly comprising current-conductive circuitry, the circuit board assemblies being attached to opposed hub ends of the hub structure; and a resilient detent member, the detent member comprising opposed, upwardly extending detent-engaging arms, the upwardly extending detent-engaging arms resiliently and simultaneously engaging arc-spaced sets of detent teeth configured to selectively position the arm assembly in a select arm position, the arm being longitudinally and laterally positionable via the arm-receiving aperture and the hub structure being respectively rotatively and axially displaceable via longitudinal and lateral positions, the current-conductive circuitry being selectively engageable with the terminals via select arm assembly positions configured to enable signals to pass through select circuitry, said terminals being electrically communicable with a plurality of pickups configured to direct signals from the pickups through the terminals and select circuitry for further signal output, the switch assembly thus configured to enable the user to selectively alter pickup signal output.

9. The pickup switch assembly of claim 8 wherein each detent-engaging arm comprises a detent-engaging tooth, the detent-engaging teeth configured to engage the arc-spaced sets of detent teeth for enhancing tactile feedback from the select arm position.

10. The pickup switch assembly of claim 9 wherein the arc-spaced sets of detent teeth comprise first and second gear halves and a tooth-interconnecting center ridge, the tooth-interconnecting center ridge configured to provide structural separation between the first and second gear halves, said structural separation for further enhancing tactile feedback from the switch assembly when positioning the arm assembly laterally.

11. The pickup switch assembly of claim 10 wherein the detent-engaging arms comprise arched sections, the arched sections configured to enhance strength in the detent-engaging arms when positioning the arm assembly laterally.

12. The pickup switch assembly of claim 8 wherein the hub structure is pin-fixed relative the arm structure, said pin-fixation configured to transfer force from the arm structure into the hub structure for axially displacing the same when positioning the arm assembly laterally.

13. The pickup switch assembly of claim 12 wherein the hub structure is transversely non-circular, the transversely non-circular hub structure being received in a non-circular aperture formed in the arm structure, the non-circular hub structure and noncircular aperture configured to direct rotational force into the hub structure when positioning the arm longitudinally.

14. A pickup switch assembly configured to enable a user to selectively alter pickup signal output, the pickup switch assembly comprising:

an arm assembly, the arm assembly comprising a central hub structure and an arm structure, the central hub structure comprising first detent means, the arm structure comprising an arm;

instrument-interfacing means for interfacing the switch assembly with an instrument;

laterally opposed terminal base plate assemblies, the base plate assemblies each comprising a terminal base plate and a series of terminals, the terminal base plates each being attached to the interface means and comprising a hub-receiving aperture, the hub-receiving apertures receiving the hub structure, the hub structure being axially displaceable as received by the hub-receiving apertures;

opposed circuit board assemblies, each circuit board assembly comprising current-conductive circuitry, the circuit board assemblies being attached to opposed hub ends of the hub structure and being axially displaceable between a first lateral indexing position and a second lateral indexing position configured to complete circuitry with the terminals; and second detent means, the second detent means being cooperable with the first detent means for selectively positioning the arm assembly in a select arm position, the arm assembly being longitudinally and laterally positionable, the current-conductive circuitry being selectively engageable with the terminals via select arm assembly positions configured to enable pickup signals to pass therethrough, the switch assembly thus configured to enable the user to selectively alter pickup signal output.

15. The pickup switch assembly of claim 14 wherein the first detent means comprise detent teeth and the second detent means comprise a resilient detent member, the detent member resiliently engaging the detent teeth and configured to enhance tactile feedback from the select arm position.

16. The pickup switch assembly of claim 15 wherein the detent member is Y-shaped, the Y-shaped detent member comprising upwardly extending detent-engaging arms, each detent-engaging arm comprises a detent-engaging tooth, the detent-engaging teeth configured to engage the arc-spaced sets of detent teeth for enhancing tactile feedback from the select arm position.

17. The pickup switch assembly of claim 16 wherein the arc-spaced sets of detent teeth comprise first and second gear halves and a tooth-interconnecting center ridge, the tooth-interconnecting center ridge configured to provide structural separation between the first and second gear halves, said structural separation for further enhancing tactile feedback from the switch assembly when positioning the arm assembly laterally.

18. The pickup switch assembly of claim 17 wherein the detent-engaging arms comprise arched sections, the arched sections configured to enhance strength in the detent-engaging arms when positioning the arm assembly laterally.

19. The pickup switch assembly of claim 14 wherein the structure is pin-fixed relative the arm structure, said pin-fixation configured to transfer force from the arm structure into the hub structure for axially displacing the same when positioning the arm assembly laterally.

20. The pickup switch assembly of claim 19 wherein the hub structure is transversely non-circular, the transversely non-circular hub structure being received in a non-circular aperture formed in the structure, the non-circular hub structure and noncircular aperture configured to direct rotational force into the hub structure when positioning the arm longitudinally.

* * * * *